United States Patent [19]

Simon et al.

[11] Patent Number: 4,946,571

[45] Date of Patent: Aug. 7, 1990

[54] ELECTRODE

[75] Inventors: Heinrich Simon, Langenselbold; Reinhard Koch, Freigericht, both of Fed. Rep. of Germany

[73] Assignee: Heraeus Elektroden GmbH, Hanau, Fed. Rep. of Germany

[21] Appl. No.: 272,894

[22] PCT Filed: May 6, 1988

[86] PCT No.: PCT/EP88/00385

§ 371 Date: Oct. 17, 1988

§ 102(e) Date: Oct. 17, 1988

[87] PCT Pub. No.: WO88/08889

PCT Pub. Date: Nov. 17, 1988

[30] Foreign Application Priority Data

May 13, 1987 [DE] Fed. Rep. of Germany ..... 8706827

[51] Int. Cl.[5] ..... C25D 17/00

[52] U.S. Cl. ..... 204/206

[58] Field of Search ..... 204/206

[56] References Cited

U.S. PATENT DOCUMENTS 2,271,736 2/1942 Hall ..... 204/206

4,421,623 12/1983 Koch et al. ..... 204/206

FOREIGN PATENT DOCUMENTS 8218599 5/1983 France .

*Primary Examiner*—T. M. Tufariello

*Attorney, Agent, or Firm*—Frishauf, Holtz, Goodman & Woodward

[57] ABSTRACT

Electrodes for electrochemical treatment of metal strips, in particular for electrolytically coating metal strips, in which a plurality of spacer elements having an electrically insulating surface protrude from the electrode surface facing the strip to be treated during operation, are known. In order to devise an electrode that has a longer service life than known electrodes, the spacer elements are spacer rollers aligned in the same travel direction with respect to one another, and the roller diameter is between 20 and 60 mm.

10 Claims, 2 Drawing Sheets

Figure 1:
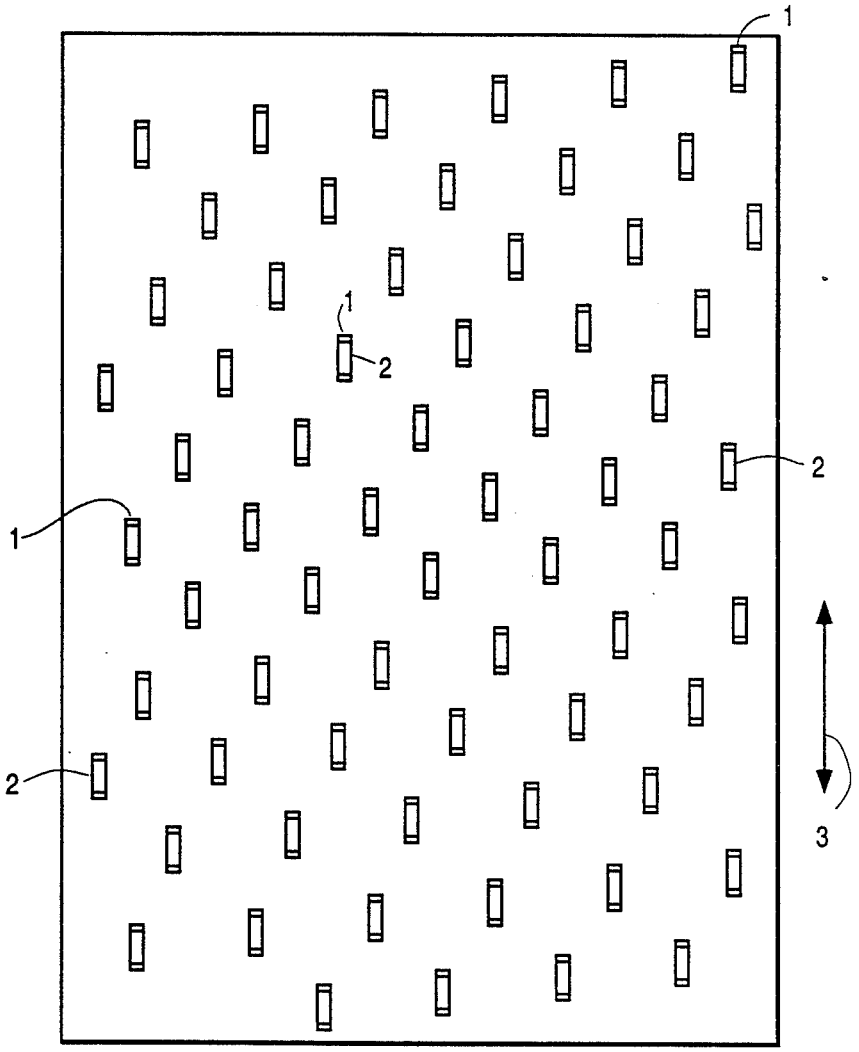

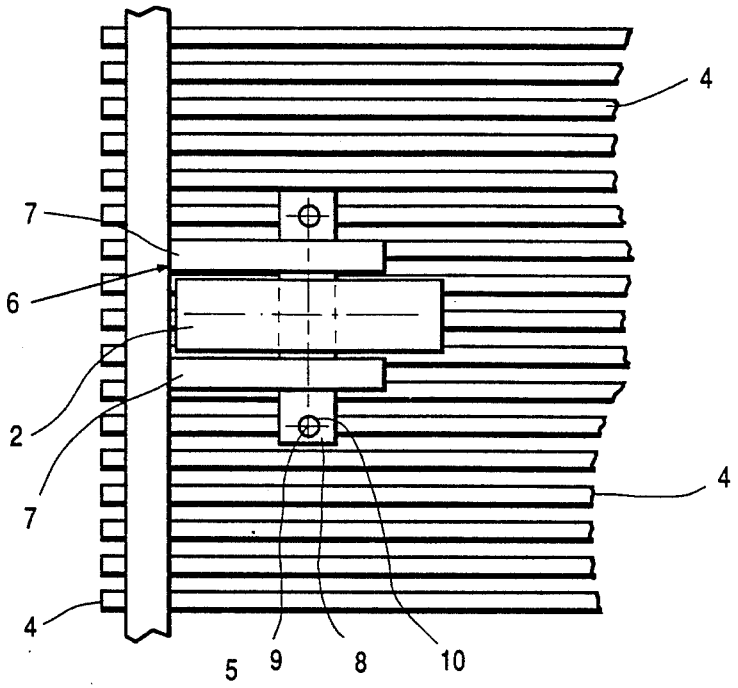
FIG. 2
FIG. 3
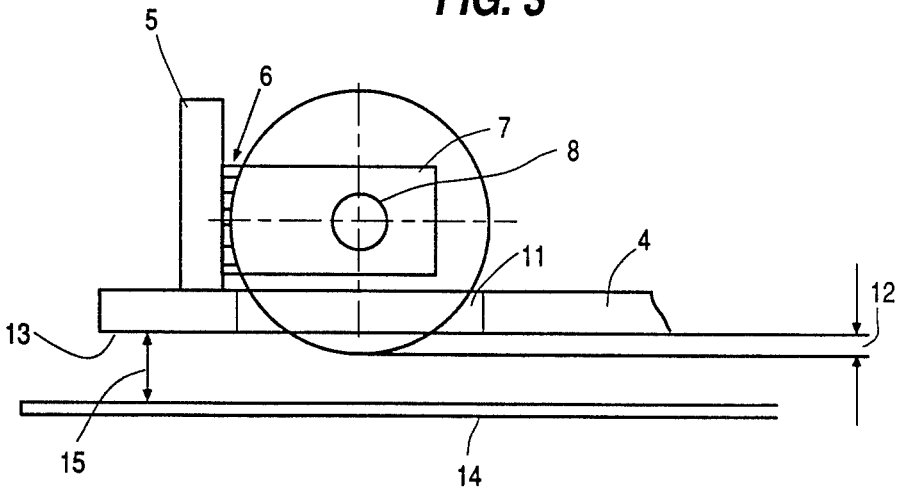

ELECTRODE

The invention relates to an electrode for the electrochemical treatment of metal strips, in particular for the electrolytic coating of metal strips, wherein a plurality of spacer elements having an electrically insulating surface protrude from the electrode surface that in operation faces the strip to be treated.

Electrodes of this type are widely known. A system in which such electrodes are used is described for instance in German Patent Disclosure Document No. DE-OS 22 34 424. In this system, a metal strip to be coated is guided through a treatment chamber in which electrolyte fluid is located. Electrodes wired as anodes are disposed along a horizontal plane, while the metal strip is connected to negative potential. The metal strip is guided with tension and in a spaced-apart manner along the anodes.

Systems for electrolytic coating of metal strips are known in which the strip travels along the electrode at speeds of from 60 to 80 meters per minute. Especially at such high speeds on the part of these thin metal strips of approximately 0.8 mm in thickness, vibration occurs. This can cause the metal strip to come into contact with the anodes, for example because of uneven motion of the tension rollers, resulting in a short circuit; the anodes are destroyed, and flaws appear in the metal strip to be coated. To prevent contact between the metal strip and the anodes, insulating strips are provided on the electrodes crosswise to the direction of travel of the metal strip, or individual insulating buttons are inserted into the electrodes. It has been found that these insulating strips or buttons are subject to severe wear from contact with the metal strip, so that they must be replaced from time to time.

Based on this prior art, the present invention has the object of devising an electrode that has an increased service life by comparison with the known electrodes.

This object is attained in that the spacer elements are spacer rollers aligned in the same direction of travel with respect to one another, and that the roller diameter is between 20 and 60 mm.

By means of the spacer rollers protruding from the surface, the friction between the metal strip and the spacer elements is reduced, because upon contact with the metal strip, the spacer rollers are rotated along with it, in the direction of travel of the strip. To assure easy rotation of the spacer rollers, on the one hand, and to decrease the effective electrode surface area only slightly, on the other, a diameter of the spacer rollers between 20 and 60 mm, preferably between 25 and 45 mm, has proved to be suitable. Virtually no wear of the spacer rollers is ascertainable.

The spacer rollers should protrude by 3 to 15 mm beyond the surface facing the strip to be treated. In order to activate the electrode surfaces from time to time, it is advantageous for the spacer rollers to be supported such that they can be removed and then replaced, which makes the electrode surfaces freely accessible. A suitable arrangement for this is for the spacer rollers to be supported on a bearing block having a releasable bearing bolt; preferably, the axis of rotation of the spacer rollers is located beneath that electrode part that forms the active electrode surface. In this arrangement, the bearing bolt is easily accessible for removal and replacement.

Preferably, from 25 to 100 spacer rollers per square meter are distributed over the electrode, depending on the height to which the spacer rollers protrude from the electrode surface. For spacer rollers protruding only slightly beyond the electrode surface, the number of spacer rollers should be between 80 to 100 per square meter.

To attain good flow of the electrolyte, the spacer rollers are staggered with respect to one another, in particular as viewed in the direction of flow of the electrolyte. The spacer rollers are preferably of polyethylene.

Further details and features of the invention will become apparent from the ensuing description of an exemplary embodiment in conjunction with the drawing. Shown in the drawing are:

FIG. 1, an electrode in plan view;

FIG. 2, a detail showing a bar electrode from the underside in the vicinity of a spacer roller; and FIG. 3, a section taken along the line III—III of FIG. 2.

The electrode shown in FIG. 1, which by its outer dimensions forms a rectangle, has a great number of recesses 1, into which spacer rollers 2 are inserted. The spacer rollers 2, of polyethylene, are aligned such that they point with their travel direction in the direction of passage of a method strip, not shown, guided above them, as indicated by the arrow 3. As seen both in the direction of the arrow 3 and at right angles thereto, the spacer rollers 2 are staggered with respect to one another, so that the electrolyte flowing past them mixes well. Adjacent spacer rollers 2 have a mean spacing from one another of approximately 10 cm; this results in a number of spacer rollers 2 distributed over the surface of the electrode of approximately 90 to 100 spacer rollers per square meter.

The support of the individual electrodes is shown in FIGS. 2 and 3. The electrode shown is a bar electrode. This bar electrode has individual bars, oriented parallel with respect to one another, which are connected with one another on their top by a plurality of current distributor bars 5. The individual spacer rollers 2, in this exemplary embodiment of the electrode, are retained on a bearing block 6 that comprises two supports 7 welded to the current distributor bar 5. The spacer roller 2 is releasably retained on these supports 7 of the bearing block 6 by means of a bearing bolt 8. The bearing bolt 8 is secured by pins 10 that are introduced into the bores 9.

As FIG. 3 shows, the spacer roller 2 extends through a recess 11, which is formed by an interruption between two bars 4. The spacer roller 2, as indicated by the arrows 12, protrudes 4 mm beyond the surface 13 of the electrode. The metal strip 14 in this exemplary embodiment is moved past the surface 13 of the electrode at a distance of 15 mm, indicated by reference numeral 15. The diameter of the spacer roller 2 is 60 mm.

I claim:

1. Electrode for the electrochemical treatment of metal strips, wherein a plurality of spacer elements having an electrically insulating surface protrude from the electrode surface that in operation faces the strip to be treated, characterized in that the spacer elements are spacer rollers (2) aligned in the same direction of travel with respect to one another, and that the roller diameter is between 20 and 60 mm.

2. Electrode of claim 1, characterized in that the spacer rollers are let into recesses (1; 11) of the electrodes.

3. Electrode of claim 2, characterized in that the roller diameter is 25 to 45 mm.

4. Electrode of claim 1, characterized in that the spacer rollers (2) protrude from 3 to 15 mm beyond the electrode surface (13) facing the strip to be treated.

5. Electrode of claim 1, characterized in that the axes of rotation of the spacer rollers (2) are located below that electrode part that forms the active electrode surface (13).

6. Electrode of claim 1, characterized in that each spacer roller (2) is retained on a bearing block (6) with a releasable bearing bolt (8).

7. Electrode of claim 1, characterized in that from 25 to 100 spacer rollers (2) are distributed per square meter.

8. Electrode of claim 7, characterized in that the number of spacer rollers (2) is 80 to 100 per square meter.

9. Electrode of claim 1, characterized in that the spacer rollers (2) are staggered with respect to one another.

10. Electrode of claim 1, characterized in that the spacer rollers (2) comprise polyethylene.

* * * * *